United States Patent [19]

Cole

[11] Patent Number: 5,046,896

[45] Date of Patent: Sep. 10, 1991

[54] INFLATABLE BUOYANT NEAR SURFACE RISER DISCONNECT SYSTEM

[75] Inventor: Charles M. Cole, Katy, Tex.

[73] Assignee: Conoco Inc., Ponca City, Okla.

[21] Appl. No.: 531,180

[22] Filed: May 30, 1990

[51] Int. Cl.[5] ..... E21B 43/013; B63B 35/00

[52] U.S. Cl. ..... 405/195; 405/203; 405/224; 405/188; 166/344; 166/350; 166/352; 166/367

[58] Field of Search ..... 166/344, 345, 350, 352, 166/359, 367, 355; 405/195, 203, 204, 205, 224, 188

[56] References Cited

U.S. PATENT DOCUMENTS

| | | | |
|---|---|---|---|
| 3,196,958 | 7/1965 | Travers et al. | 175/7 |
| 3,525,388 | 8/1970 | McClintock . | |
| 3,720,066 | 3/1973 | Vilain | 405/202 |
| 4,047,579 | 9/1977 | Wilckens et al. | 175/7 |
| 4,182,584 | 1/1980 | Panicker et al. | 405/195 |
| 4,234,047 | 11/1980 | Mott | 175/5 |
| 4,284,143 | 8/1981 | Scherrer et al. | 166/350 |
| 4,391,332 | 7/1983 | Fayren | 166/350 |
| 4,400,109 | 8/1983 | Gentry et al. | 405/195 |
| 4,403,658 | 9/1983 | Watkins | 166/355 |
| 4,423,984 | 1/1984 | Panicker et al. | 405/195 |
| 4,436,451 | 3/1984 | Anderson | 405/195 |
| 4,448,266 | 5/1984 | Potts | 175/7 |
| 4,462,717 | 7/1984 | Falcimaigne | 405/195 |
| 4,478,586 | 10/1984 | Gentry et al. | 405/195 X |
| 4,547,163 | 10/1985 | Langpaap et al. | 441/2 |
| 4,616,707 | 10/1986 | Langner | 166/345 |
| 4,643,614 | 2/1987 | Laursen | 405/169 |
| 4,740,109 | 4/1988 | Horton | 405/224 |
| 4,762,180 | 8/1988 | Wybro et al. | 166/350 |

FOREIGN PATENT DOCUMENTS

| | | | |
|---|---|---|---|
| 1519203 | 7/1978 | United Kingdom | 166/367 |

OTHER PUBLICATIONS

"Development of the 13,200 Ft. Riser for the Ocean Margin Drilling Program", (undated but admitted to be more than one year prior to filing).

Yokohama Catalog No. CN-0303S-02E, "Yokohama Floating Fenders Pneumatic 50 & 80", ©1986, The Yokohama Rubber Co., Ltd., Tokyo, Japan.

*Primary Examiner*—Dennis L. Taylor
*Assistant Examiner*—John A. Ricci
*Attorney, Agent, or Firm*—A. Joe Reinert

[57] ABSTRACT

A riser system includes inflatable buoyancy bladders and a near surface disconnect so that a drilling vessel can rapidly disconnect from the riser leaving the riser in a freestanding buoyant position.

27 Claims, 2 Drawing Sheets

INFLATABLE BUOYANT NEAR SURFACE RISER DISCONNECT SYSTEM

BACKGROUND OF THE INVENTION

1. Field of the Invention

The invention relates to buoyant riser systems, and more particularly, to buoyant riser systems utilizing inflatable bladders to provide the requisite buoyancy.

2. Description of the Prior Art

In offshore drilling systems, a riser extends from the blowout preventers at the ocean floor to the drilling vessel floating on the ocean surface. When a storm such as a hurricane approaches the drilling site, it is necessary for the drilling vessel to disconnect from the well. Typically, the riser is disconnected at the ocean floor, and the entire riser must be retrieved and laid down in joints on the floating vessel. A substantial period of time is required to accomplish such disconnect operations, and there is a very significant accompanying cost for drilling vessel down time. It is not uncommon in locations such as the Gulf of Mexico for a drilling ship to have to disconnect several times because of approaching storms during a typical hurricane season.

It has also been proposed to utilize buoyant risers wherein a substantial portion of the riser above the ocean floor is buoyant so that it can be disconnected from the drilling vessel. U.S. Pat. No. 4,234,047 to Mott discloses such a disconnectable buoyant riser system. These systems have typically been proposed utilizing rigid steel cans for buoyancy. Mott suggests with regard to FIGS. 6 and 7 thereof the use of collapsible flexible walled buoyancy tanks.

Jacobs and Homer, "Development of the 13,200 ft. Riser for the Ocean Margin Drilling Program" have proposed another design for a freestanding buoyant riser system using rigid can type flotation.

Inflatable bladders like those proposed for use in the present invention as buoyancy members are available in the art for other purposes. Yokohama Catalog No. CN-0303S-02E entitled "Yokohama Floating Fenders Pneumatic 50 and 80" discloses floating inflatable fenders.

Thus, although the art has included suggestions for the use of inflatable buoyancy tanks on risers as shown in the Mott U.S. Pat. No. 4,234,047, no workable system for the use of inflatable buoyancy elements on risers has yet been proposed.

SUMMARY OF THE INVENTION

The present invention provides a riser system including a riser string extending upward from a floor of a body of water to a floating platform at the surface of the body of water. The riser string includes a lower riser portion, an intermediate riser portion, and an upper riser portion.

A releasable connector is provided between the intermediate riser portion and the upper riser portion for permitting the upper riser portion to be selectively disconnected from and reconnected to the intermediate riser portion.

A plurality of inflatable bladders of sufficient buoyancy to support the lower riser portion and the intermediate riser portion are provided and are supported from the intermediate riser portion on a supporting structure which transfers the buoyant force from the bladders to the intermediate riser portion.

A first flexible joint is provided between the lower riser portion and the intermediate riser portion for permitting the intermediate riser portion and the inflatable bladders and support structure to float substantially vertically to aid in reconnection of the releasable connector between the intermediate riser portion and the upper riser portion.

The inflatable bladders each have an air inlet and an air outlet. A back pressure conduit is connected to the air outlet and extends downward therefrom a distance below the bladder so that the air pressure required to displace water from the back pressure conduit is sufficient to inflate the bladder sufficiently to make the riser buoyant.

The support structure includes a link chain net structure for containing the bladder and transferring the buoyant force from the bladder to the riser.

A multiplexed electrohydraulic blowout preventer control line assembly is carried by the riser string. The control line assembly includes an upper control line portion carried by the upper riser portion, a lower control line portion carried by the intermediate and lower riser portions, a stab-in connector for connecting the upper and lower control line portions, and a spool connected to the support structure for storing any extra length of the lower control line portion.

Other related improvements in the construction of buoyant riser systems are also set forth.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
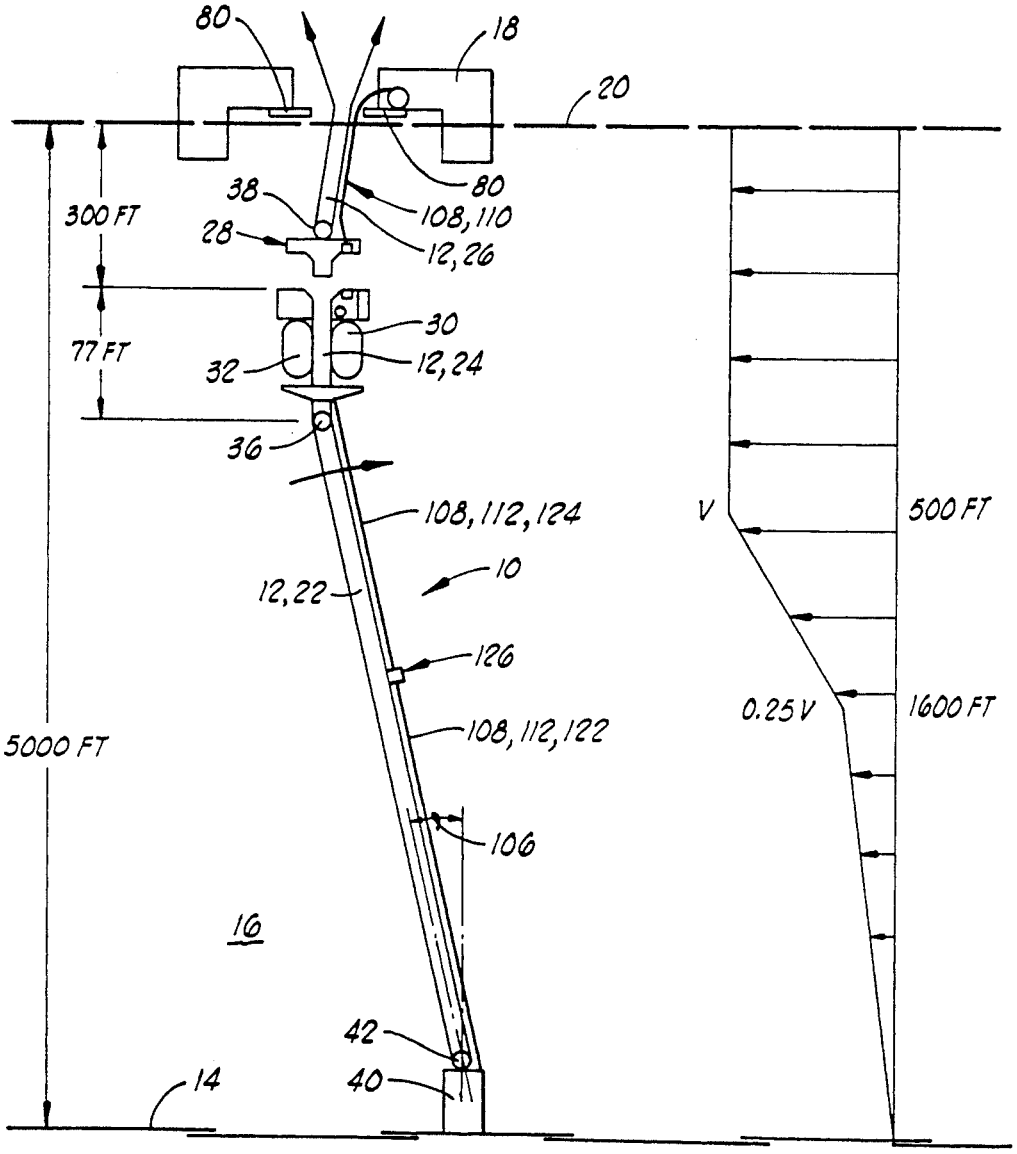
FIG. 1 is a schematic illustration of a buoyant riser system extending between a subsea well and a floating drilling rig. A typical current velocity profile is displayed adjacent the riser system.

Referring now to the drawings, and particularly to FIG. 1, a riser system is shown and generally designated by the numeral 10. The riser system 10 includes a riser string 12 extending upward from a floor 14 of a body of water 16 to a floating drilling rig or platform 18 at the surface 20 of the body of water. The riser string 12 includes a lower riser portion 22, an intermediate riser portion 24, and an upper riser portion 26.

System 10 includes a releasable connector means generally designated by the numeral 28 between the intermediate riser portion 24 and the upper riser portion 26 for permitting the upper riser portion 26 to be selectively disconnected from and reconnected to the intermediate riser portion 24. Connector means 28 includes a conventional high angle hydraulic subsea wellhead connector 29.

Figure 2:
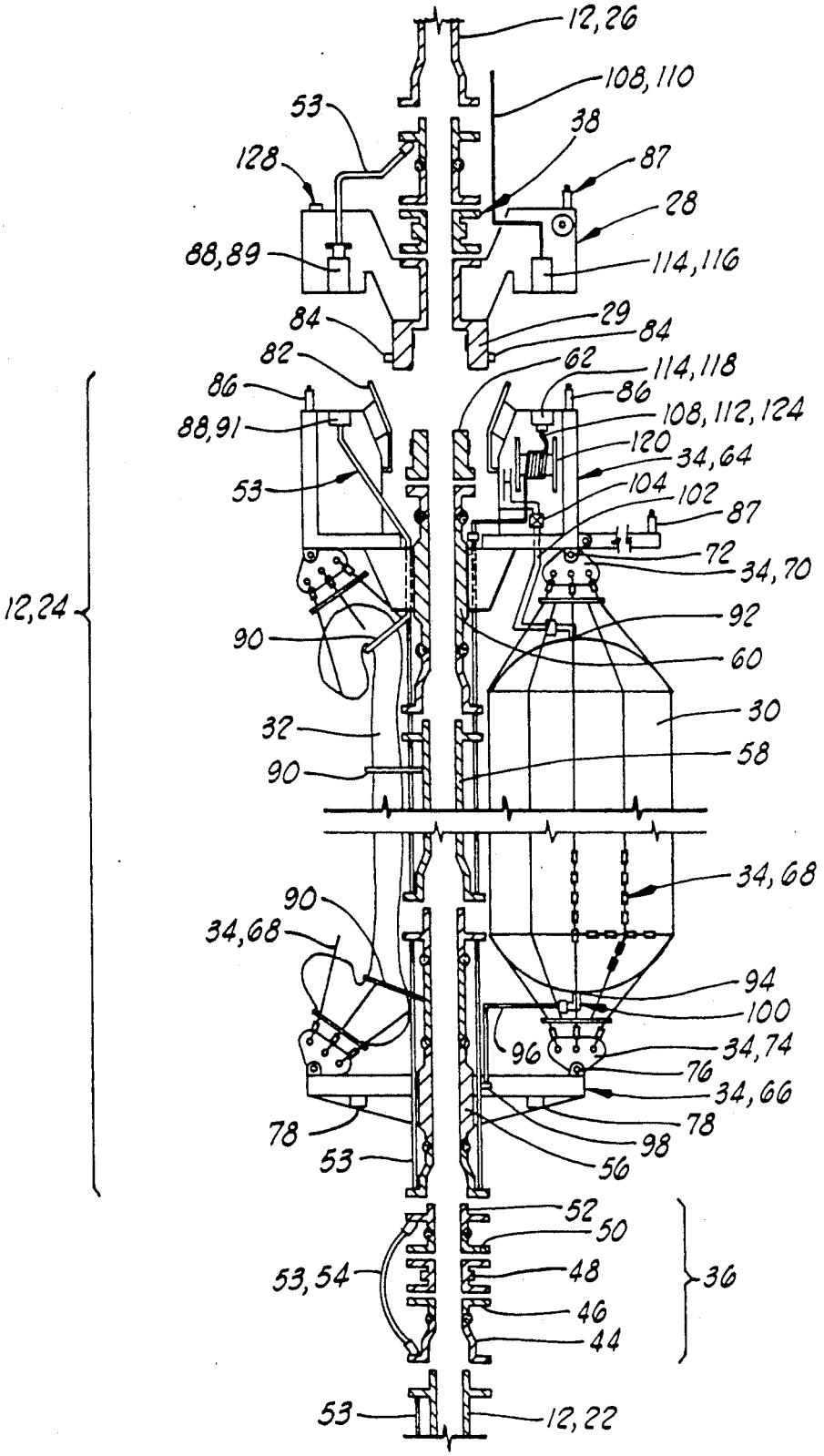
FIG. 2 is an elevation, partially sectioned, somewhat schematic, partially exploded view of the intermediate riser portion with its associated buoyancy system, a flexible joint between the intermediate riser portion and the lower riser portion, and the lower end of the upper riser portion along with the releasable connector which connects the upper riser portion to the intermediate riser portion.

A plurality of inflatable bladders such as 30 and 32 are provided. In the illustration of FIG. 2 only two such bladders are visible, but in a preferred embodiment, four bladders like those illustrated in FIG. 2 are utilized with the bladders being spaced at 90° about the longitudinal axis of the riser. The bladders such as 30 and 32 are of sufficient buoyancy to support the lower riser portion 22 and the intermediate riser portion 24 after the upper riser portion 26 is disconnected therefrom.

The system 10 includes a support means generally designated by the numeral 34 for supporting the inflatable bladders from the intermediate riser portion 24 so that a buoyant force of the bladders is transferred to the intermediate riser portion 24.

A first flexible joint means 36 is provided between the lower riser portion 22 and the intermediate riser portion 24 for permitting the intermediate riser portion and the inflatable bladders such as 30 and 32 along with support means 34 to float substantially vertically to aid in reconnection of the releasable connector means 28 between the intermediate riser portion 24 and upper riser portion 26.

A second flexible joint means 38 is disposed in the connector means 28 above the hydraulic connector 29 for accommodating misalignment between the upper riser portion 26 and the intermediate riser portion 24 when disconnecting and reconnecting the releasable connector means 28.

The riser string 12 extends upward from a blowout preventer 40 located on the ocean floor 14. A third flexible joint 42 is provided between lower riser portion 22 and blowout preventer 40 to accommodate angular displacement of the riser string 12 from a vertical orientation relative to blowout preventer 40.

The details of construction of these various components are best seen in FIG. 2.

The first flexible joint means 36 located between the intermediate riser portion 24 and lower riser portion 22 permits the intermediate riser portion 24 and the portions thereof associated with releasable connecting means 28 to float in a near vertical orientation thus aiding in reconnection of the upper riser portion 26 with intermediate riser portion 24 in any current profile. The flexible joint means 36 also reduces associated stresses and fatigue in the riser components.

The flexible joint means 36 includes a riser adapter 44, a flange connection 46, a flex joint 48, another flange connection 50, and another riser adapter 52. Also included are a plurality of flexible hoses such as 54 for the choke and kill lines, rigid conduit line, and mud boost lines which extend along the length of the riser string 12 as will be understood by those skilled in the art. A representative one of such lines, namely choke line 53, is illustrated in FIG. 2.

The intermediate riser portion 24 includes a lower thick walled pipe section 56, a riser pup joint 58, and an upper thick walled pipe section 60. A conventional well head mandrel 62 is attached to the upper end of the upper thick wall pipe section 60 and is constructed to be assembled with the high angle hydraulic subsea well head connector 29.

The support means 34 associated with intermediate riser portion 24 includes upper and lower support beam structures 64 and 66 which are rigidly attached to the upper and lower thick walled pipe sections 60 and 56, respectively. Each of the inflatable bladders such as bladder 30 has associated therewith a net 68 constructed of link chain. In FIG. 2, the net 68 is primarily shown with a single line drawing for ease of illustration, with only a representative portion of the net for bladder 30 being drawn as link chain.

An upper padeye connection 70 is pivotally connected to upper support beam structure 64 at pivot pin 72 and is connected to the upper end of link chain net 68. A lower padeye 74 is connected to lower support beam structure 66 at a pivot pin 76 and is connected to the lower end of the link chain net 68.

A plurality of retractable skid beams 78 are illustrated in the lower support beam structure 66 to allow landing of the lower support beam structure 66 on the spider beams 80 (see FIG. 1) of the drilling rig 18. Similar retractable skid beams (not shown) are included in the upper support beam structure 64.

The length of the riser pup joint 58 is chosen to provide the required height between the lower support beam structure 66 and upper support beam structure 64 to accommodate the inflatable bladders such as 30 and 32. Also, the pup joint 58 allows the upper and lower support beam structures 64 and 66 to be disconnected from each other for transport and for ease of handling on the drilling rig 18.

At the upper end of the intermediate riser portion 24 there is a guide funnel 82 surrounding mandrel 62 for guiding the hydraulic connector 29 into engagement with the mandrel 62. Keys 84 are defined on the hydraulic connector 29 and are associated with complementary alignment grooves (not shown) in the funnel 82 for properly defining the angular orientation of the connector means 28 and apparatus associated therewith relative to the upper support beam structure 64 and various apparatus carried thereby. Dowel pins 86 carried by the upper support beam structure 64 are received in complementary recesses (not shown) defined in the releasable connector means 28 for positive alignment of the releasable connector means 28 with the upper support beam structure 64.

The mandrel 62, funnel 82 and related structure can generally be considered to be part of the connector means 28 for connecting upper riser portion 26 to lower riser portion 24.

Acoustic position transponders 87 are provided for aiding in positioning of the upper riser portion 26 relative to the intermediate riser portion 24 as they are reconnected.

A retractable stab means 88 having upper and lower portions 89 and 91 is provided for connection of the various lines such as choke line 53 when the connector means 28 connects the upper riser portion 26 with the intermediate riser portion 24.

The buoyant air bladders such as 30 and 32 can be floating type fenders such as those sold by The Yokohama Rubber Co., Ltd., of Tokyo, Japan, and particularly the floating type Yokohama pneumatic rubber fenders marketed as their Pneumatic-50 and Pneumatic-80 models are suitable.

In FIG. 2, the inflatable bladder 32 is illustrated in an uninflated position, and the inflatable bladder 30 is illustrated in an inflated position. When the bladders are in their uninflated position as illustrated for bladder 32, a flangible securing strap means 90 is provided for securing the inflatable bladders to the intermediate riser portion 24. When the bladder is inflated, the flangible securing strap means 90 will break thus releasing the bladder so that it can fully inflate.

The system utilized to inflate the bladders is illustrated in FIG. 2 with regard to bladder means 30. An air inlet 92 is provided at the top of bladder 30. An air outlet 94 is provided at the bottom of bladder 30. A back pressure conduit 96 having a rigid vertical portion is connected to the air outlet 94 and extends downward therefrom a distance to an open lower end 98 thereof. This distance is sufficient so that the air pressure required to displace all water from the back pressure conduit 96 is sufficient to fully inflate the bladder 30. That is, the hydraulic head required to displace water from the back pressure conduit 96 must be provided by air pressure within the bladder 30, and thus the vertical distance by which the back pressure conduit 96 extends below the bladder 30 determines the differential pressure which will be present inside the bladder 30 when it is inflated. When air pressure inside the bladder 30 tends to exceed that necessary to fully displace all water from the back pressure conduit 96, excess air will simply bleed through the back pressure conduit 96 and out the open lower end 98 thereof.

Preferably, a check valve means 100 is provided in the back pressure conduit 96 below air outlet 94 for preventing water from entering the bladder 30 upon deflation thereof.

A compressed air supply line 102 extends downward from a compressed air supply (not shown) located on the floating vessel 18 and is connected to the air inlet 92 of inflatable bladder 30. A fail-safe closed control valve 104 is disposed in each of the air supply lines 102. The control valves 104 may be electrically or hydraulically powered. Upon power failure, the valves will close if they are not already closed thus insuring against accidental deflation of the bladder 30.

The lower pivot pin 76 in the lower padeye 74 is preferably an instrumented load pin 76 which provides a buoyancy measuring means 76 for monitoring the buoyancy provided by the inflated bladder 30.

The differential pressure required inside the bladder 30 to fully inflate the same relates directly to the inflated height of the bladder 30. A fully inflated 35-foot tall bladder would require 16 psi plus several psi to positively maintain its shape to provide full buoyancy. This pressure is well within the test pressure for Yokohama fenders like those identified above, which test pressure is typically 45 psi. The effective buoyant force of the inflated bladder means 30 is a direct function of the weight of water displaced by the bladder 30.

For example, four fully inflated 11-foot diameter by 35-foot tall Yokohama fenders would provide over 800,000 pounds of gross buoyancy. The wet weight of the various components of the riser system 10 supported by the bladders is subtracted to obtain the gross buoyancy of the system. For example, a system like that illustrated in FIG. 2 is calculated to have a wet weight of approximately 145,000 pounds, giving a net buoyancy for the system with four 11-foot diameter by 35-foot tall fenders of over 655,000 pounds.

For the current profile illustrated in FIG. 1, wherein there is a substantially uniform current from zero to 500-foot depth, then a current decreasing in a straight line to one-fourth the surface current as depth increases from 500 to 1600 feet, then decreasing again in straight line to zero as depth increases from 1600 feet to 5,000 feet which is the depth of the ocean floor in the example. For that velocity profile, a buoyancy of over 655,000 pounds as applied to a riser system like that illustrated would support the riser with a maximum deviation angle 106 from vertical of 8° in 5,000 feet of water with a current of well over three knots. Since drilling operations could not be conducted in such a current, this amount of net buoyancy should be sufficient.

The pressure required to inject the compressed air into the inflatable bladders 30 and 32 is a function of the water depth. For example, for 200 to 500 feet of water, the pressure would vary from 89 to 222 psi plus line friction losses and the required positive buoyancy. The air would normally be injected while preparing the well and the drilling rig 18 for a hurricane evacuation. The air injection lines 102 should be sized to minimize the friction loss pressure at the inflation rates possible with the air compressor equipment available on the drilling platform 18.

As illustrated in FIG. 1, for the example given, the upper riser portion 26 has a length of approximately 300 feet, and the intermediate riser portion 24 has a length of approximately 77 feet, with the overall length of the riser string 12 being approximately 5,000 feet.

The riser string 12 also carries control lines for the blowout preventor 40. For water depths up to about 4,000 feet, the blowout preventer control lines can be conventional hydraulic systems. In such a case a retractable stab like retractable stab means 88 can be utilized. If, however, water depths are greater than 4,000 feet, hydraulic blowout preventer control systems are not normally considered satisfactory due to slow response times. In those situations a multiplexed electrohydraulic blowout preventer control system is utilized. This is illustrated in FIGS. 1 and 2. A multiplexed electrohydraulic blowout preventer control line assembly 108 includes an upper control line portion 110 carried by the upper riser portion 26 and a lower control line portion 112 carried by the intermediate and lower riser portions 24 and 22.

A stab-in connector means 114 having upper and lower parts 116 and 118 is associated with a releasable connector means 28 for connecting the upper and lower control line portions 110 and 112. Two basic types of connectors can be utilized for the stab-in connector 114. The first is a non-ferric stab with wipers and multiple contacts such as presently utilized in the remote operated vehicle industry. The second type of connector is an induction connector, such as those used in subsea multiplexed production control systems wherein the connections are completely sealed from sea water. The selection of a reliable wet multiplex connector 114 will permit disconnection of the multiplexed line assembly 108 at the upper riser disconnect means 28 in order to evacuate the well site for a hurricane. Also reconnection of the multiplex cable assembly 108 will be permitted after the storm has passed.

A spool means 120 is connected to the upper support beam structure 64 for storing any extra length of the lower control line portion 112.

The lower control line portion 112, as best seen in FIG. 1, includes a basic fixed length 122 of multiplexed cable for use with the shallowest proposed water depth for which the system 10 is designed. For drilling operations in deeper water, the lower control line portion 112 includes a second multiplex cable extension portion 124. A dry multiplex connection 126 is provided between multiplex cable portions 122 and 124. Any excess part of the multiplex cable extension portion 124 is stored on the spool 120.

The various controls necessary for the releasable connection means 28 can be efficiently and economically installed by using a conventional hydraulic hose bundle (not shown). The jacketed bundle will contain the required number of 3/16-inch control hoses for the number of functions associated with the releasable connecting means 28 plus spares. The control bundle could also be manufactured to contain the electric cables that will be required for potential functions such as the instrumented padeye pins 76, an electric angle indicator 128, or other functions.

INSTALLATION AND OPERATION PROCEDURES

Depending upon the type of substructure and moon pool of the drilling rig 18 selected, the components for the buoyant riser could be run through the rig floor or assembled at the spider beams 80. A second gimballed spider would be required at the spider deck level to allow landing the riser string 12 and for making the connections of the various system components.

The inflatable bladders should be run in deflated position providing substantially no buoyancy. The light securing straps 90 hold the uninflated bladders within the dimensions required to run through the moon pool and keep them secure during normal operations, and then the straps 90 will fail upon inflation of the bladders.

When a hurricane or other storm approaches the well site, the bladders such as 30 and 32 are inflated by directing compressed air thereto through the air injection lines 102. The final inflation pressure in the inflatable bladders is determined by the vertical length of the back pressure control lines 96.

Complete inflation of the bladders should be visually confirmed by a remote operated vehicle. Buoyancy being provided by each bladder can also be monitored by the instrumented pivot pin 76 in the lower padeyes.

Then the releasable connector 28 is disconnected from the intermediate riser portion 24 so that the drilling rig 18 is free to move away from the well site.

On return of the drilling vessel 18 after a hurricane evacuation, reestablishment of the connection between the upper riser portion 26 and intermediate riser portion 24 will be accomplished. Acoustic references provided from transponders 87 will aid in positioning of the components to be reconnected. Visual references can also be provided through the use of remote operated vehicles. After the reconnection has been made, the bladders are deflated by venting through the inflation lines 102 to the atmosphere to allow the bladders to lose their buoyancy and collapse. Water is prevented from entering the bladders as they deflate due to the check valves 100.

It is noted that an added benefit may be gained from the riser system 10 as an assist to the riser tensioners (not shown) on the drilling vessel 18. This may allow a drilling rig 18 with marginal riser tension capacity to operate in deeper waters or with higher mud weights than it otherwise could. The instrumented load pins 76 would monitor the tension being applied by partial inflation of the bladders or possibly by full inflation of only two of the bladders.

Thus it is seen that the apparatus of the present invention readily achieves the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. A riser system, comprising:

a riser string extending upward from a floor of a body of water, to a floating platform at the surface of said body of water, said riser string including a lower riser portion, an intermediate riser portion, and an upper riser portion;

a releasable connector means, between said intermediate riser portion and said upper riser portion, for permitting said upper riser portion to be selectively disconnected from and reconnected to said intermediate riser portion;

an inflatable bladder means of sufficient buoyancy to support said lower riser portion and said intermediate riser portion;

support means for supporting said inflatable bladder means from said intermediate riser portion so that a buoyant force of said bladder means is transferred to said intermediate riser portion; and a first flexible joint means between said lower riser portion and said intermediate riser portion, for permitting said intermediate riser portion and said inflatable bladder means and said support means to float substantially vertically to aid in reconnection of said releasable connector means between said intermediate riser portion and said upper riser portion.

2. The riser system of claim 1, further comprising:

a second flexible joint means, associated with said releasable connector means, for accommodating misalignment between said upper riser portion and said intermediate riser portion when disconnecting and reconnecting said releasable connector means.

3. The riser system of claim 1, further comprising:

a choke line carried by said riser string; and wherein said first flexible joint means includes a flexible hose portion of said choke line.

4. The riser system of claim 1, wherein:

said bladder means includes a plurality of inflatable bladders; and said support means includes nets containing said inflatable bladders.

5. The riser system of claim 4, wherein:

said nets are constructed of link chain.

6. The system of claim 4, wherein said support means further comprises:

upper and lower support structures attached to said intermediate riser portion, said nets being connected between said upper and lower support structures.

7. The system of claim 6, wherein said support means further comprises:

a plurality of pivotal connector means for pivotally connecting each of said nets to said lower support structure.

8. The system of claim 7, wherein:

each of said pivotal connector means includes a padeye connection to said lower support structure.

9. The system of claim 6, wherein:

said intermediate riser portion includes upper and lower thick wall pipe segments and a riser pup joint extending between said upper and lower thick wall pipe segments; and said upper and lower support structures of said support means are rigidly attached to said upper and lower thick wall pipe segments, respectively.

10. The system of claim 1, further comprising:

retractable landing beam means, attached to said support means, for landing said support means on a spider beam of a floating drilling rig.

11. The system of claim 1, wherein:
said releasable connector means includes a high angle hydraulic wellhead connector connected to a lower end of said upper riser portion, and a mandrel connected to an upper end of said intermediate riser portion, said mandrel being constructed to be received in and latched to said wellhead connector.

12. The system of claim 11, wherein:
said releasable connector means further includes a guide funnel means mounted on said intermediate wellhead portion, for guiding said wellhead connector into engagement with said mandrel.

13. The system of claim 1, further comprising:
a multiplexed electrohydraulic blowout preventor control line assembly carried by said riser string, said control line assembly including:
an upper control line portion carried by said upper riser portion;
a lower control line portion carried by said intermediate and lower riser portions;
a stab-in connector means, associated with said releasable connector means, for connecting said upper and lower control line portions; and
spool means, connected to said support means for storing any extra length of said lower control line portion.

14. The system of claim 1, wherein:
said inflatable bladder means includes an air inlet at a top thereof and an air outlet at a bottom thereof.

15. The system of claim 14, further comprising:
a back pressure conduit, connected to said air outlet of said inflatable bladder means and extending downward therefrom a distance so that the air pressure required to displace all water from said back pressure conduit is sufficient to fully inflate said inflatable bladder means.

16. The system of claim 15, further comprising:
check valve means disposed in said back pressure conduit for preventing water from entering said inflatable bladder means upon deflation thereof.

17. The riser assembly of claim 14, further comprising:
a compressed air supply line connected to said air inlet of said inflatable bladder means; and
a fail-safe closed control valve disposed in said air supply line.

18. The system of claim 1, further comprising:
frangible securing strap means for securing said inflatable bladder means to said intermediate riser portion when said bladders are in an uninflated position.

19. The system of claim 1, further comprising:
buoyancy measuring means for monitoring the buoyancy provided by said inflatable bladder means.

20. The system of claim 1, further comprising:
a second flexible joint means, between said lower riser portion and the floor of said body of water, for allowing said riser string to flex relative to said floor.

21. A buoyant riser system, comprising:
a riser extending upward from a floor of a body of water;
inflatable bladder means connected to said riser for buoying said riser upon inflation of said bladder means, said bladder means having an air inlet and an air outlet defined therein; and
a back pressure conduit connected to said air outlet and extending downward therefrom a distance below said bladder means so that the air pressure required to displace water from said back pressure conduit is sufficient to inflate said bladder means sufficiently to make said riser buoyant.

22. The system of claim 21, further comprising:
check valve means for preventing water from flowing into said bladder means upon deflation thereof.

23. The system of claim 21, further comprising:
a compressed air supply line connected to said air inlet of said bladder means; and
a fail-safe closed control valve disposed in said air supply line.

24. A buoyant riser system, comprising:
a riser extending upward from a floor of a body of water;
inflatable bladder means connected to said riser for buoying said riser upon inflation of said bladder means; and
support means for supporting said bladder means from said riser and for transferring a buoyant force from said bladder means to said riser, said support means including a net means for containing said bladder means,
said support means further including a support structure fixedly attached to said riser, and a pivotal connector means for connecting said net means to said support structure and for transferring said buoyant force from said net means to said support structure.

25. The system of claim 24, wherein:
said pivotal connector means includes a padeye connection to said support structure.

26. The system of claim 25, wherein:
said padeye connection includes an instrumented load pin means for measuring said buoyant force.

27. A riser system, comprising:
a riser string extending upward from a floor of a body of water, to a floating platform at the surface of said body of water, said riser string including a lower riser portion, an intermediate riser portion, and an upper riser portion;
a releasable connector means, between said intermediate riser portion and said upper riser portion, for permitting said upper riser portion to be selectively disconnected from and reconnected to said intermediate riser portion;
an inflatable bladder means of sufficient buoyancy to support said lower riser portion and said intermediate riser portion;
support means for supporting said inflatable bladder means from said intermediate riser portion so that a buoyant force of said bladder means is transferred to said intermediate riser portion; and
a multiplexed electrohydraulic blowout preventor control line assembly carried by said riser string, said control line assembly including:
an upper control line portion carried by said upper riser portion;
a lower control line portion carried by said intermediate and lower riser portions;
a stab-in connector means, associated with said releasable connector means, for connecting said upper and lower control line portions; and
spool means, connected to said support means for storing any extra length of said lower control line portion.

* * * * *